US008336992B2

(12) United States Patent
Nukui

(10) Patent No.: US 8,336,992 B2
(45) Date of Patent: Dec. 25, 2012

(54) LIQUID DISCHARGE APPARATUS

(75) Inventor: Kosuke Nukui, Nagoya (JP)

(73) Assignee: Brother Kogyo Kabushiki Kaisha, Aichi-ken (JP)

( * ) Notice: Subject to any disclaimer, the term of this patent is extended or adjusted under 35 U.S.C. 154(b) by 430 days.

(21) Appl. No.: 12/607,165

(22) Filed: Oct. 28, 2009

(65) Prior Publication Data

US 2010/0110143 A1 May 6, 2010

(30) Foreign Application Priority Data

Oct. 30, 2008 (JP) ..... 2008-279503

(51) Int. Cl.
*B41J 2/135* (2006.01)
*B41J 2/175* (2006.01)

(52) U.S. Cl. ..... 347/44; 347/85

(58) Field of Classification Search ..... None
See application file for complete search history.

(56) References Cited

U.S. PATENT DOCUMENTS 6,755,514 B2 6/2004 Koga
7,063,409 B2 6/2006 Koga
7,537,322 B2 * 5/2009 Ishikawa et al. ..... 347/85
2007/0109367 A1 5/2007 Sakurai
2007/0146445 A1 6/2007 Nukui et al.

FOREIGN PATENT DOCUMENTS

JP 2003-175588 6/2003
JP 2007-130969 5/2007
JP 2007-176068 7/2007

* cited by examiner

*Primary Examiner* — Matthew Luu
*Assistant Examiner* — Lisa M Solomon
(74) *Attorney, Agent, or Firm* — Frommer Lawrence & Haug LLP

(57) ABSTRACT

A liquid discharge apparatus includes a liquid discharge head which reciprocates in a first direction on a predetermined plane, which discharges liquids, and which has connecting ports arranged in a second direction; liquid supply sources which store the liquids; and flexible tubes which are arranged in a state of being bent and each of which constructs a part of a liquid flow passage, and first ends of the tubes are connected to the connecting ports; the tubes are arranged in a third direction intersecting the predetermined plane at fixed portions of the tubes; and each of the tubes has an external shape of which cross section perpendicular to an extending direction of the tube is elliptical; and at least at one of the first end and the fixed portion, a major axis direction of the cross section is the third direction.

13 Claims, 11 Drawing Sheets

LIQUID DISCHARGE APPARATUS

CROSS REFERENCE TO RELATED APPLICATION

The present application claims priority from Japanese Patent Application No. 2008-279503, filed on Oct. 30, 2008, the disclosure of which is incorporated herein by reference in its entirety.

BACKGROUND OF THE INVENTION

1. Field of the Invention

The present invention relates to a liquid discharge apparatus for discharging liquids from nozzles.

2. Description of the Related Art

An image recording apparatus described in United States Patent Application Publication No. 2007/0146445 A1 (corresponding to Japanese Patent Application Laid-open No. 2007-176068), which is exemplified as a liquid discharge apparatus for discharging liquids from nozzles, includes an ink-jet head which is movable reciprocatively in the scanning direction and which discharges inks from the nozzles, and ink cartridges which are provided for a main body, and the ink-jet head and the ink cartridges are connected to one another by a plurality of flexible tubes, and the plurality of tubes are arranged in a state of being bent so that the plurality of tubes can follow the movement of the ink-jet head. The plurality of tubes have first ends which are connected to the ink-jet head respectively in a state of being disposed in the direction perpendicular to the vertical direction and the scanning direction. Further, the plurality of tubes are fixed in a state of being disposed in the vertical direction at predetermined fixed portions which are intermediate portions thereof and which have positions in relation to the perpendicular direction different from those of the first ends connected to the ink-jet head. Accordingly, it is possible to decrease the height of the ink-jet head as compared with a case in which the plurality of tubes are connected to the ink-jet head in a state of being disposed in the vertical direction.

As described in United States Patent Application Publication No. 2007/0146445 A1, the reaction forces, which intend to restore the plurality of tubes from the bent state to the original state, are generated in the plurality of tubes arranged in the bent state. When the plurality of tubes are fixed while being disposed in the vertical direction at the fixed portions and the plurality of tubes are connected to the ink-jet head while being disposed in the direction perpendicular to the vertical direction and the scanning direction, then the reaction forces also act in the vertical direction, because the heights of the plurality of tubes differ between the first ends and the fixed portions respectively. On the other hand, in order to realize the recording of an image on a larger recording paper sheet by using the image recording apparatus as described above, it is necessary that large amounts of the inks should be supplied to the ink-jet head. For this purpose, it is necessary to increase the diameters of the tubes.

However, when the diameter of the tube is increased, if the thickness of the tube is increased in conformity with the increase in the diameter of the tube, then the reaction force is increased corresponding thereto. It is feared that the tube may float upwardly due to the action of the reaction force exerted in the vertical direction. On the contrary, if the thickness of the tube is decreased, then the upward floating of the tube as described above can be avoided, because the reaction force is decreased. However, it is feared that the liquid contained in the tube may escape to the outside and/or the gas may enter the tube from the outside, because the thickness of the tube is small.

SUMMARY OF THE INVENTION

An object of the present invention is to provide a liquid discharge apparatus which makes it possible to prevent the liquid contained in a tube from escaping to the outside and prevent the gas from entering the tube from the outside, while avoiding any upward floating of the tube which would be otherwise caused by the reaction force generated by bending the tube.

According to a first aspect of the present invention, there is provided a liquid discharge apparatus including a liquid discharge head which reciprocates in a first direction on a predetermined plane, which discharges the liquids from nozzles and which has a plurality of connecting ports arranged in a second direction on the predetermined plane; liquid supply sources which store the liquids to be supplied to the liquid discharge head; and a plurality of flexible tubes which are arranged in a state of being bent and each of which constructs a part of a liquid flow passage from one of the liquid supply sources to the liquid discharge head, and first ends of the tubes are connected to the connecting ports respectively; the tubes are arranged in a third direction intersecting the predetermined plane at fixed portions of the tubes, the fixed portions being located at positions different from positions of the connecting ports of the liquid discharge head in relation to a direction which is perpendicular to the first direction and parallel to the predetermined plane; and each of the tubes has an external shape of which cross section perpendicular to an extending direction of the tube is elliptical; and at least at one of the first end and the fixed portion, a major axis direction of the cross section is the third direction.

Accordingly, the tubes are arranged in the third direction at the fixed portions, while the connecting ports of the liquid discharge head for connecting the tubes are arranged in the second direction parallel to the predetermined plane. Thus, it is possible to decrease the length of the liquid discharge head in relation to the third direction.

Further, the cross section of each of the tube, which is perpendicular to the extending direction thereof, is elliptical, and the major axis direction of the cross section is the third direction at least at one of the first end and the fixed portion. Therefore, the thickness in the bending direction is decreased, and the reaction force, which is generated in the tube by being bent and which intends to restore the tube to the original state, is decreased. Accordingly, it is possible to prevent the tubes from floating upwardly. On the other hand, the thickness of the tube, which is in the direction perpendicular to the bending direction, is large. Therefore, it is possible to prevent the water of the liquid contained in the tube from escaping to outside, and it is possible to avoid the gas from entering the tube from outside. The term "second direction" means any direction on the predetermined plane, which includes the first direction and the direction perpendicular to the first direction as well.

According to a second aspect of the present invention, there is provided a liquid discharge apparatus including a liquid discharge head which reciprocates in a first direction on a predetermined plane, which discharges the liquids from nozzles and which has a plurality of connecting ports arranged in a second direction on the predetermined plane; liquid supply sources which store the liquids to be supplied to the liquid discharge head; and a plurality of flexible tubes which are arranged in a state of being bent and each of which constructs a part of a liquid flow passage from one of the liquid supply sources to the liquid discharge head, and first ends of the tubes are connected to the connecting ports respectively; the tubes are arranged in a third direction intersecting the predetermined plane at fixed portions of the tubes, the fixed portions being located at positions different from positions of the connecting ports of the liquid discharge head in relation to a direction which is parallel to the predetermined plane and which is perpendicular to the first direction; and each of the tubes has a wall thicknesses in a direction perpendicular to a bending direction of the tubes which is thicker than a wall thicknesses thereof in the bending direction, at least at a portion in an extending direction of each of the tubes.

In the second aspect of the present invention, since each of the tubes has a thin wall thicknesses in the bending direction of the tubes, at least at a portion in an extending direction of each of the tubes, a reaction force which is generated in the tube and intends to restore the tube from the bent state to the original state is small. Accordingly, it is possible to prevent the tubes from floating upwardly. On the other hand, since each of the tubes has a thick wall thicknesses in the direction perpendicular to the bending direction of the tubes, it is possible to prevent the water of the liquid contained in the tube from escaping to outside, and it is possible to avoid the gas from entering the tube from outside.

DESCRIPTION OF THE PREFERRED EMBODIMENTS

Figure 1:
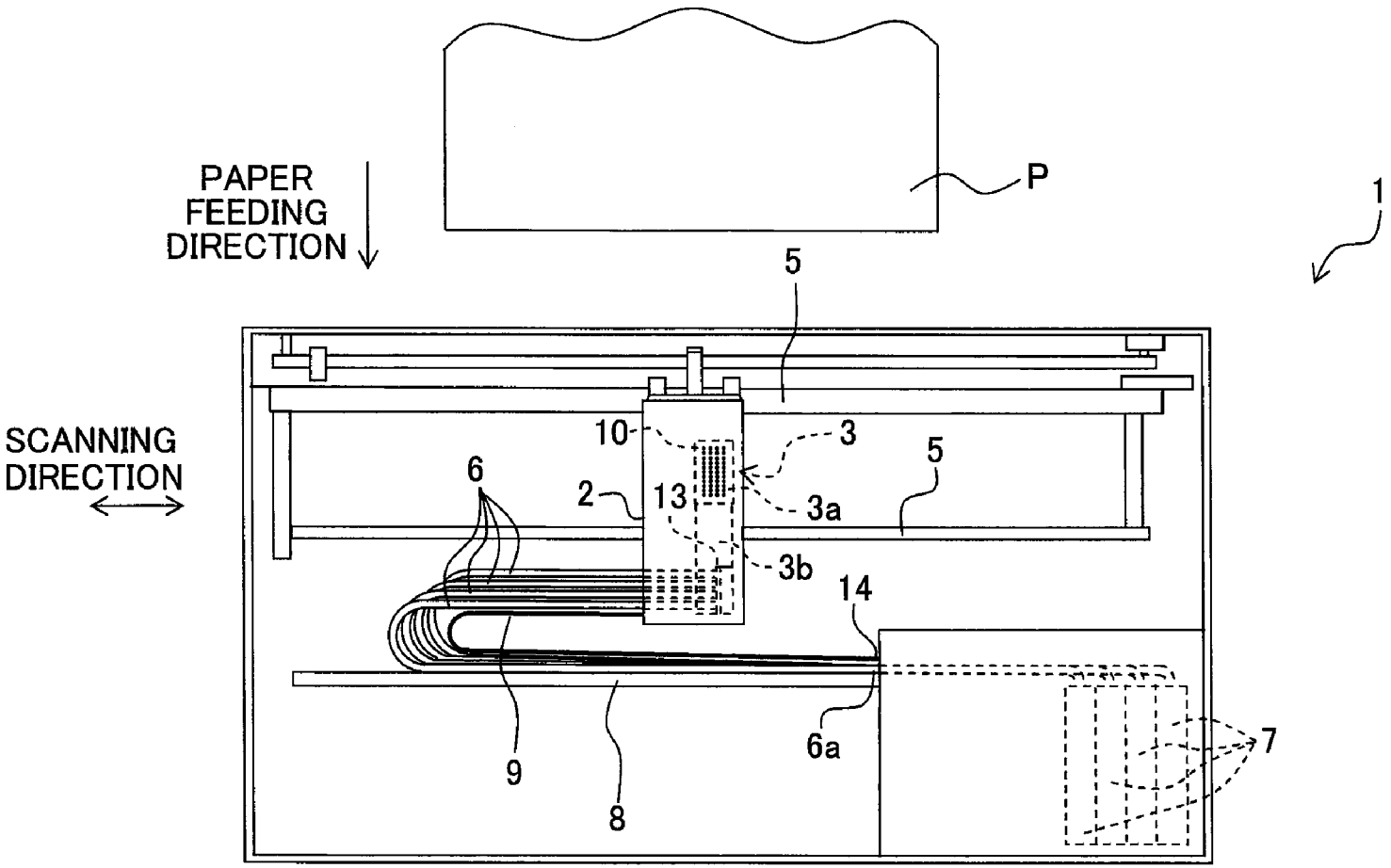
FIG. 1 shows a schematic arrangement of a printer according to an embodiment of the present invention.
Figure 2:
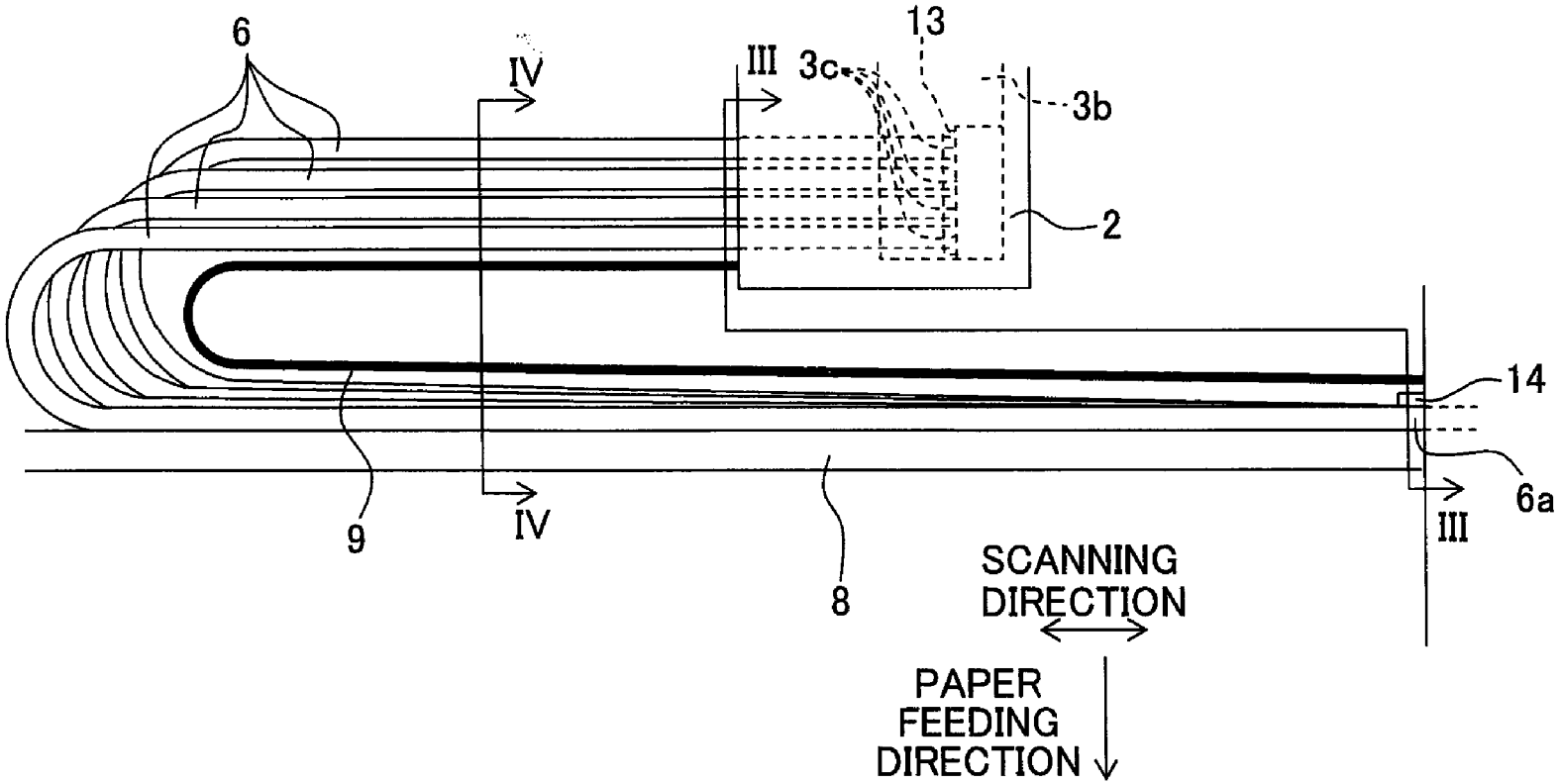
FIG. 2 shows a partial magnified view illustrating those disposed in the vicinity of tubes shown in FIG. 1.

A preferred embodiment of the present invention will be explained below.

As shown in FIGS. 1 to 4, a printer 1 (liquid discharge apparatus) includes, for example, a carriage 2, an ink-jet head 3 (liquid discharge head), four tubes 6, four ink cartridges 7, a tube guide 8 (guide member), and a flexible flat cable (FFC) 9 (flexible wiring member).

The carriage 2 is reciprocatively movable in the scanning direction (left-right direction as viewed in FIG. 1, first direction) parallel to the horizontal plane (predetermined plane) along two guide shafts 5 arranged in parallel to one another. The ink-jet head 3 has a head body 3*a* and a subtank unit 3*b*. The head body 3*a* is arranged on the lower surface of the carriage 2 to discharge inks from nozzles 10 formed on the lower surface thereof.

Unillustrated subtanks, which are provided to temporarily store the inks to supply the inks to the head body 3*a*, are arranged in the subtank unit 3*b*. Further, the subtank unit 3*b* is formed with, for example, unillustrated ink flow passages connected to the subtanks. The subtank unit 3*b* is connected to the head body 3*a*, and the subtank unit 3*b* extends downwardly as viewed in FIG. 1 from portions at which the subtank unit 3*b* is connected to the head body 3*a*. Four connecting ports 3*c*, which are disposed in the upward-downward direction as viewed in FIG. 1 (second direction parallel to the horizontal plane), are provided at lower end portions of the subtank unit 3*b* as shown in FIG. 1. First ends of the tubes 6 are connected to the four connecting ports 3*c* respectively.

The four ink cartridges 7 (liquid supply sources) are arranged at lower-right end portions of the printer 1 as viewed in FIG. 1, and they are disposed in the scanning direction. The inks of black, yellow, cyan, and magenta are stored in the four ink cartridges 7 respectively. The other ends or second ends of the tubes 6 are connected thereto. Accordingly, the inks, which are stored in the ink cartridges 7, are supplied to the ink-jet head 3 via the tubes 6.

A recording paper sheet P is transported in the downward direction (paper feeding direction) as viewed in FIG. 1 by means of an unillustrated recording paper transport mechanism. The inks are discharged from the nozzles 10 of the ink-jet head 3 which is moved in the scanning direction together with the carriage 2. Accordingly, the printing can be performed on the recording paper sheet P.

The tube 6 is composed of a flexible material such as a synthetic resin including, for example, low density polyethylene. The cross section of the tube 6, which relates to the direction perpendicular to the extending direction thereof, has a substantially elliptical shape (the term, which is hereinafter simply referred to as "cross section of the tube 6", refers to the cross section in relation to the concerning direction). The cross section of the space 6*b* formed therein in relation to the concerning direction is circular. Accordingly, the thickness of the tube 6 is large in relation to the major axis direction of the cross section, and the thickness of the tube 6 is small in relation to the minor axis direction of the cross section. Specifically, as for the tube in which the black ink flows, the inner diameter is about 1.6 mm, and the thickness in the minor axis direction (wall thickness in the bending direction) and the thickness in the major axis direction (wall thickness in the direction perpendicular to the bending direction) are about 0.4 mm and about 0.8 mm respectively. As for each of the tubes in which each of the color inks other than the black ink flow, the inner diameter is about 1.25 mm, and the thickness in the minor axis direction and the thickness in the major axis direction are about 0.45 mm and about 0.9 mm respectively. In other words, the thickness in the major axis direction is about twice the thickness in the minor axis direction.

As described above, the first ends of the tubes 6 are connected to the connecting ports 3*c* of the ink-jet head 3, and the tubes 6 extend from the connecting ports 3*c* in the leftward direction as viewed in FIG. 1. The tubes 6 are curved by about 180°, and the tubes 6 extend in the rightward direction as viewed in FIG. 1. As described above, the other ends or second ends thereof are connected to the ink cartridges 7. In other words, the tubes 6 are extending from the first ends in the leftward direction as viewed in FIG. 1, and are bent back in a U-shape in the middle of the tubes 6. The reason, why the tubes 6 are arranged while being bent as described above in this arrangement, is that it is intended to allow the tubes 6 to follow the carriage 2 when the carriage 2 is moved in the scanning direction.

The tubes 6 are disposed in the vertical direction (third direction) at fixed portions 6*a* which are intermediate portions between the bent portions and the ink cartridges 7. Further, the tubes 6 are fixed while being interposed between a fixing member 14 and the tube guide 8. In this arrangement, all of the fixed portions 6*a* of the tubes 6 are disposed under or below the connecting ports 3*c* of the ink-jet head 3 as viewed in FIG. 1 (positions of the fixed portions 6*a* in relation to a direction, which is along the predetermined plane and perpendicular to the first direction, are different from those of the connecting ports 3*c*). The fixed portions 6*a* are positioned over or above the connecting ports 3*c* of the ink-jet head 3 in relation to the vertical direction. In other words, the connecting ports 3*c* of the ink-jet head 3 are arranged under or below (on one side of) the fixed portion 6*a* which is positioned on the lowermost side (at one end) and which is included in the fixed portions 6*a* of the four tubes 6. Alternatively, the connecting ports 3*c* of the ink-jet head 3 may be arranged at the same height as that of the fixed portion 6*a* which is positioned at the lowermost position.

The four tubes 6 are fixed in a state of being mutually bundled by a connecting member 13 at the first ends thereof which are connected to the connecting ports 3*c* of the ink-jet head 3. In other words, the connecting member 13 is a member to fix the four tubes 6 while aligning the first ends thereof in one array. The four tubes 6 can be connected to the connecting ports 3*c* at once by the connecting member 13. The tubes 6 can be easily connected to the connecting ports 3*c*. The four tubes 6 are not mutually bundled at the portions disposed between the first ends thereof and the fixed portions 6*a*, and they are deformable independently.

Figure 3:
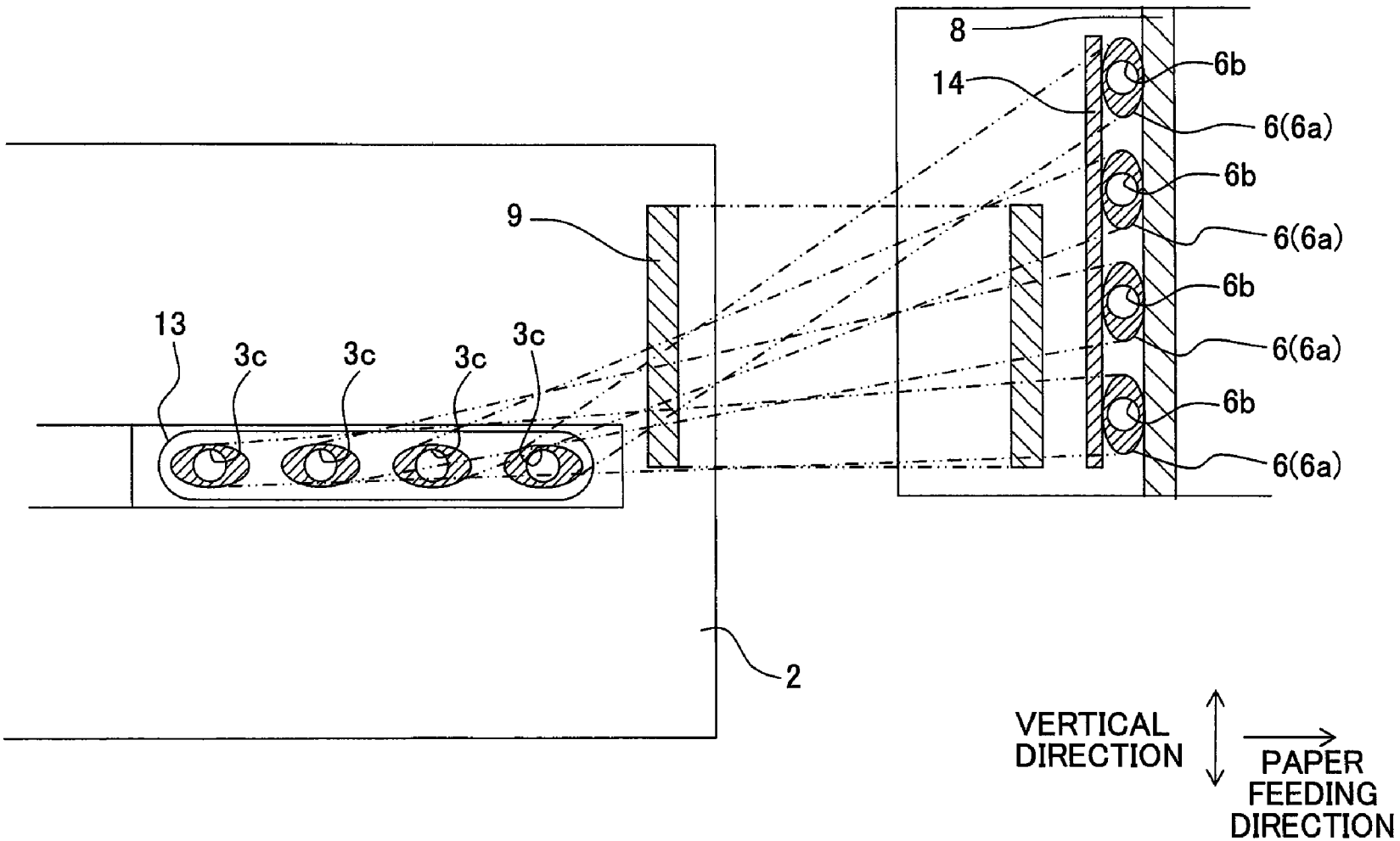
FIG. 3 shows a sectional view taken along a line shown in FIG. 2.

As shown in FIG. 3, the four tubes 6 are in a twisted state wherein the major axis directions of the cross sections thereof are the vertical direction at the fixed portions 6*a*, and the four tubes 6 are connected to the connecting ports 3*c* of the ink-jet head 3 so that the major axis directions of the cross sections thereof are the paper feeding direction.

Unlike this embodiment, if the connecting ports 3*c* of the ink-jet head 3 are disposed in the vertical direction in conformity with the arrangement of the fixed portions 6*a*, the tubes 6 can be connected to the connecting ports 3*c* without allowing the tubes 6 to be in the twisted state as described above. However, in this case, the length of the ink-jet head 3 (subtank unit 3*b*) in relation to the vertical direction is increased.

In the embodiment of the present invention, the connecting ports 3*c* of the ink-jet head 3 are disposed in the paper feeding direction. Therefore, it is possible to decrease the length of the ink-jet head 3 in relation to the vertical direction, although it is necessary that the tubes 6 should be in the twisted state as described above in order that the tubes 6, which are arranged in the vertical direction at the fixed portions 6*a*, are connected to the connecting ports 3*c* which are arranged in the paper feeding direction.

Further, the tube 6, which is included in the four tubes 6 and which is positioned more upwardly at the fixed portion 6*a*, is connected to the connecting port 3*c* which is positioned on the inner circumferential side (lower side as viewed in FIG. 1) of the bending of the tube 6 as viewed in a plan view, i.e., the connecting port 3*c* which is nearest to the fixed portion 6*a* in relation to the paper feeding direction (upward-downward direction as viewed in FIG. 1). In other words, a first tube 6, among the tubes 6, of which fixed portion 6*a* is positioned at an upper position than that of a second tube 6, among the tubes 6, is connected to a first connecting port 3*c*, among the connecting ports 3*c*, positioned nearer to the fixed portions 6*a* than a second connecting port 3*c*, among the connecting ports 3*c*, to which the second tube 6 is connected. The lengths of the four tubes 6 are approximately identical with each other in order that the flow passage resistances of the inks are uniformized. Therefore, as shown in FIGS. 1 to 4, the four tubes 6 are arranged so that the tube 6, which is positioned more downwardly, has the portion which is disposed between the first end of the tube 6 and the fixed portion 6*a* and which is positioned on the outer circumferential side of the bending of the tube 6 as viewed in a plan view (as viewed in the third direction).

In the embodiment of the present invention, as described above, the four tubes 6 are not mutually fixed at the portions which are disposed between the connecting ports 3*c* (first ends) and the fixed portions 6*a*, and they can be deformed independently. Therefore, even when the lengths of the four tubes 6 are same each other, the tubes 6 can be arranged in the twisted state so that the tube 6, which is positioned more upwardly (on the other side) at the fixed portion 6*a*, is connected to the connecting port 3*c* which is positioned on the inner circumferential side of the bending of the tube 6 as viewed in a plan view.

Figure 4:
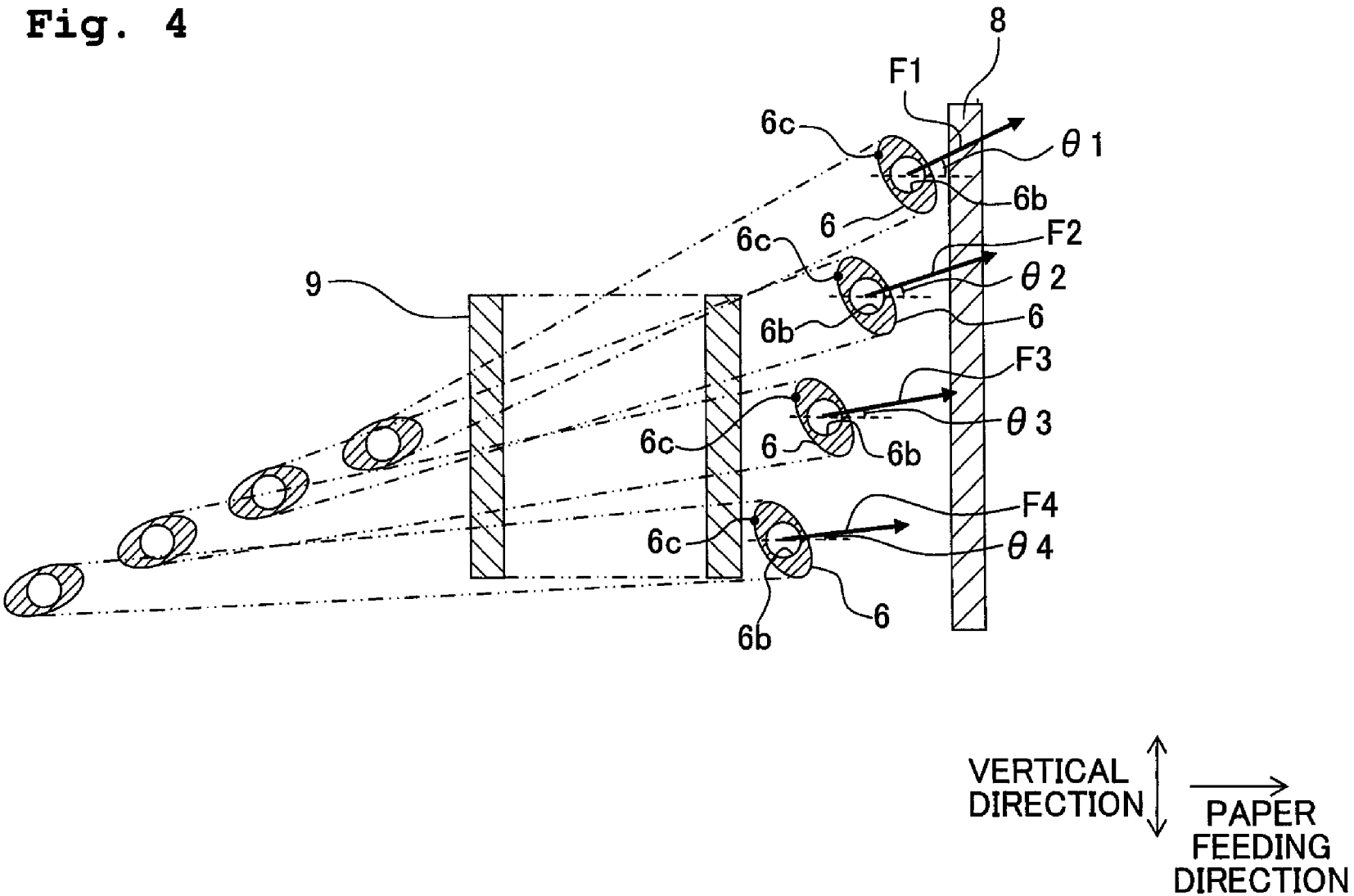
FIG. 4 shows a sectional view taken along a line IV-IV shown in FIG. 2.

As described above, the connecting ports 3*c* are positioned under or below the fixed portions 6*a*. Further, the four tubes 6 are arranged in the twisted state so that the tube 6, which is positioned at the more upward position at the fixed portion 6*a*, is connected to the connecting port 3*c* which is positioned on the inner circumferential side of the bending of the tubes 6 as viewed in a plan view. Accordingly, as shown in FIG. 4, the four tubes 6 are inclined so that the major axes of the cross sections, which are disposed at the portions located between the connecting ports 3*c* and the fixed portions 6*a*, have the upper ends which are positioned on the inner circumferential side of the bending of the tubes 6 as viewed in a plan view as compared with the lower ends. Even when the connecting ports 3*c* are disposed at the same height as that of the fixed portion 6*a* positioned at the lowermost position, the directions of inclination of the tubes 6 are the same as or equivalent to the above.

In this arrangement, the tubes 6 are bent at the portions disposed between the connecting ports 3*c* and the fixed portions 6*a* as described above. Therefore, the reaction forces F1 to F4, which intend to restore the tubes 6 from the bent state to the original state, are generated in the tubes 6 respectively. In this embodiment, the connecting ports 3*c* of the ink-jet head 3, to which the first ends of the tubes 6 are connected, are positioned at the heights which are mutually different from those of the fixed portions 6*a* of the tubes 6. Therefore, the directions of the reaction forces F1 to F4 are inclined by θ1 to θ4 respectively with respect to the horizontal plane (paper feeding direction in FIG. 4). The reaction forces F1 to F4 act not only in the paper feeding direction but also in the direction directed upwardly in the vertical direction.

In the case of the printer 1 which performs the printing by discharging the inks from the nozzles 10 of the ink-jet head 3, for example, when the printing on a large recording paper sheet P is realized, it is necessary that the amounts of the inks to be supplied to the ink-jet head 3 should be increased. For this purpose, it is necessary to increase the diameters of the tubes 6.

In such a situation, if the tubes 6 have substantially circular cross-sectional shapes unlike the embodiment of the present invention, and the thicknesses of the tubes 6 are increased in conformity with the diameters, then the reaction forces F1 to F4 described above are increased. It is feared that the tubes 6 may float upwardly due to the components of the reaction forces F1 to F4 directed upwardly in the vertical direction. Further, the reaction forces F1 to F4, which are generated in the respective tubes 6, have mutually different magnitudes and mutually different directions. As described above, the four tubes 6 are not fixed to one another at the portions disposed between the connecting ports 3*c* and the fixed portions 6*a*, and they can be deformed independently. Therefore, if the tubes 6 float upwardly, then the floating amounts may be different from each other. It is feared that the tubes 6 may be entangled with each other.

On the contrary, if the thicknesses of the tubes 6 are decreased, it is possible to avoid the upward floating of the tubes 6 which would be otherwise caused by the reaction forces as described above. However, it is feared that the water of the inks contained in the spaces 6*b* (in the tubes 6) may escape to the outside and/or the air may enter the spaces 6*b* (in the tubes 6) from the outside.

In contrast to the above, the tubes 6 have the substantially elliptical cross-sectional shapes in the embodiment of the present invention. The tubes 6 are arranged so that the major axis directions thereof are the vertical direction on the cross section at the fixed portions 6*a*. Further, the tubes 6 are connected to the connecting ports 3*c* of the ink-jet head 3 so that the major axes thereof are parallel to the horizontal plane (in the paper feeding direction in FIG. 4) (the major axis direction of the cross section at least one of the first end and the fixed portion 6*a* of the tube 6 is the third direction). Therefore, the thickness of the tube 6, which is provided in the bending direction, is decreased. Accordingly, the reaction forces as described above are decreased, and it is possible to avoid the upward floating of the tubes 6.

On the other hand, the thickness of the tube 6 is increased in relation to the direction which is perpendicular to the bending direction. Therefore, it is possible to prevent the water of the ink contained in the space 6*b* from escaping to the outside, and it is possible to prevent the air from entering the space 6*b* from the outside.

Unlike this embodiment, if the tubes 6 are connected so that the major axis directions thereof are the vertical direction on both of the cross sections at the first ends connected to the connecting ports 3*c* and the cross sections at the fixed portions 6*a*, the reaction forces, which are generated in the tubes 6, can be decreased as compared with the arrangement of the embodiment of the present invention. However, in this case, the four tubes 6 are fixed while being mutually bundled at the both ends thereof as described above. Therefore, it is difficult to connect the four tubes 6 such that the twisted state is provided, wherein the tube 6, which is positioned more upwardly at the fixed portion 6*a*, is connected to the connecting port 3*c* positioned on the inner circumferential side of the bending of the tube 6 as viewed in a plan view, and the major axis directions of the cross sections are the vertical direction at both of the fixed portions 6*a* and the connecting ports 3*c* of the tubes 6.

In view of the above, in the embodiment of the present invention, the tubes 6 are connected so that the major axis directions of the cross sections are the paper feeding direction at the first ends connected to the connecting ports 3*c*, and the major axis directions of the cross sections are the vertical direction at the fixed portions 6*a*. Accordingly, the tubes 6, which are mutually bundled and fixed at the first ends, can be easily connected to the connecting ports 3*c*.

In this arrangement, the minor axis directions of the cross sections of the tubes 6 are the vertical direction at the connecting ports 3*c*. Therefore, it is also possible to decrease the length of the ink-jet head 3 in relation to the vertical direction.

In the printer 1, when the printing operation as described above is repeatedly performed in a high temperature situation, then the tubes 6 are softened, and the tubes 6 hang down in some cases.

In such a situation, if the four tubes 6 are arranged such that the tube 6, which is positioned more upwardly at the fixed portion 6*a*, is connected to the connecting port 3*c* which is positioned on the outer circumferential side of the bending of the tubes 6 as viewed in a plan view in contrast to the embodiment of the present invention, the connecting port 3*c*, which is connected to the tube 6 positioned at the uppermost position at the fixed portion 6*a*, is greatly separated from the fixed portion 6*a* in relation to the paper feeding direction as compared with the arrangement of the embodiment of the present invention. Therefore, the angle θ1 is decreased with respect to the horizontal plane (paper feeding direction in FIG. 4) in relation to the direction of the reaction force F1 generated in the tube 6 which is positioned at the uppermost position at the fixed portion 6*a*. The magnitude of the component in the vertical direction of the reaction force F1 is decreased as compared with the arrangement of the embodiment of the present invention. Therefore, the tube 6, which is positioned at the uppermost position at the fixed portion 6*a*, greatly hangs down, and the tube 6 pushes the other three tubes 6 downwardly. As a result, it is feared that the tubes 6 may be brought in contact with any portion of the printer 1.

On the contrary, in the embodiment of the present invention, the tube 6, which is included in the four tubes 6 and which is positioned more upwardly at the fixed portion 6*a*, is connected to the connecting port 3*c* which is positioned on the inner circumferential side of the bending of the tubes 6 as viewed in a plan view. Therefore, the component of the reaction force F1 generated in the tube 6 positioned at the uppermost position at the fixed portion 6*a*, which is directed upwardly in the vertical direction, is increased to some extent, while the reaction forces F1 to F4, which are generated in the respective tubes 6 as described above, are decreased. Therefore, it is possible to prevent the other three tubes 6 from being pushed downwardly, which would be otherwise caused by the concerning tube 6 allowed to hang downwardly.

The tube guide 8 is arranged adjacently to the tubes 6 on downstream side in the paper transporting direction (lower side in FIG. 1) with respect to the tubes 6, and the tube guide 8 extends in the scanning direction. The portions, which are disposed between the bent portions of the tubes 6 and the fixed portions 6*a*, are allowed to abut against the tube guide 8. Accordingly, the tubes 6 are regulated so that the tubes 6 are not spread, which would be otherwise caused by the reaction forces F1 to F4 generated by the bending of the tubes 6.

FFC 9 is provided in order to apply, for example, the driving electric potential to the ink-jet head 3. FFC 9 is arranged adjacently to the tubes 6 on the inner circumferential side of the bending of the tubes 6 as viewed in a plan view, and FFC 9 extends in a state of being bent along with the tubes 6.

In this arrangement, as described above, the portions, which are disposed between the fixed portions 6*a* and the connecting ports 3*c* of the tubes 6, are not mutually fixed, and they can be deformed independently. Therefore, the tubes 6 are deformed and the heights thereof are changed, for example, in accordance with the movement of the carriage 2 and the reaction forces F1 to F4 generated in the tubes 6.

Figure 5A:
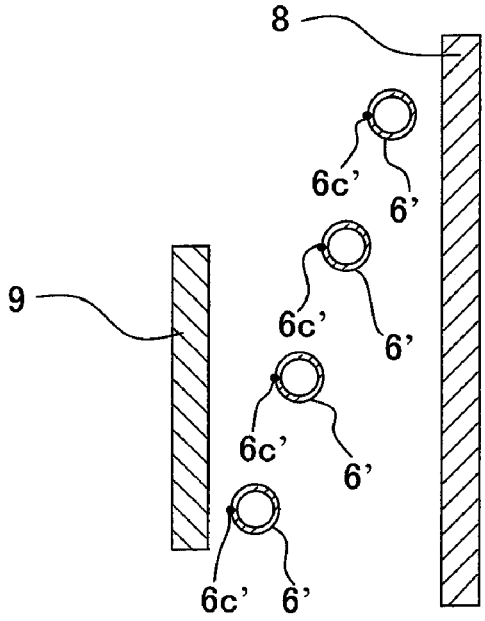
FIGS. 5A and 5B show Comparative Examples of such cases that tubes have shapes or an arrangement different from those of the embodiment.
Figure 5B:
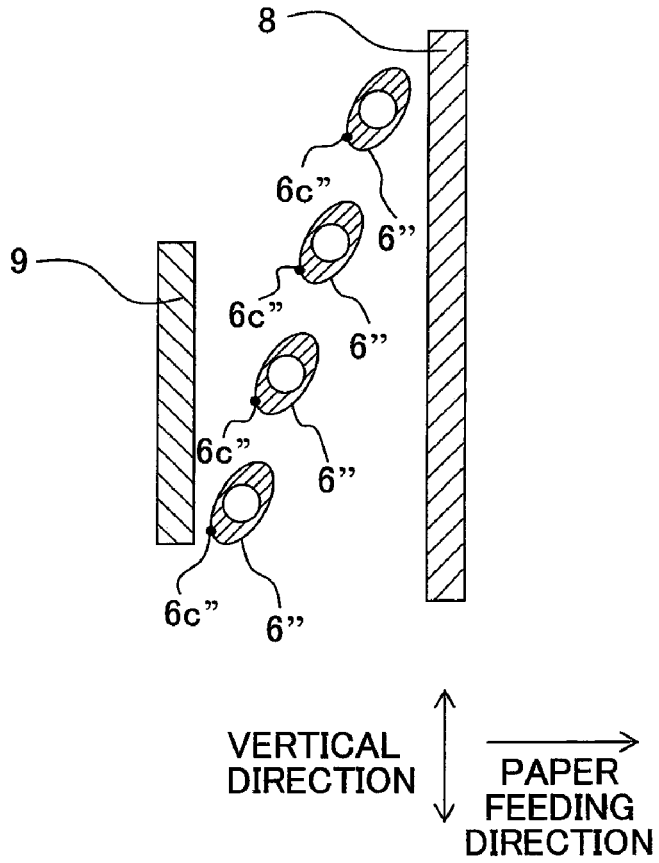

Therefore, if the tubes 6' have substantially circular cross sections, and the points 6*c*' of the tubes 6', which are disposed nearest to the FFC 9 in relation to the paper feeding direction, are at the same heights as those of the centers of the tubes 6*c*', for example, as shown in FIG. 5A unlike the embodiment of the present invention, then the lower end of FFC 9 tends to ride on the tubes 6'. As shown in FIG. 5B, if the tubes 6" have substantially elliptical cross sections, the major axes of the cross sections are inclined so that the upper end portions (ends on the other side) more approach the outer circumferential side (right side as viewed in FIG. 5) of the bending of the tubes 6" as viewed in a plan view at the portions of the tubes 6" disposed between the connecting ports 3*c* and the fixed portions 6*a*, and the points 6*c*" of the tubes 6", which are disposed nearest to FFC 9 in relation to the paper feeding direction, are at the positions lower than the centers of the tubes 6*c*", then FFC 9 tends to ride on the tubes 6". If FFC 9 rides on the tubes 6' or the tubes 6", it is feared that the tubes 6' or the tubes 6" may be damaged such that FFC 9, which rides on the tubes 6' or the tubes 6", is rubbed with the tubes 6' or the tubes 6".

However, in the embodiment of the present invention, as shown in FIG. 4, the major axes of the cross sections, which are disposed at the portions of the tubes 6 between the connecting ports 3*c* and the fixed portions 6*a*, are inclined so that the upper ends thereof are positioned on the inner circumferential side of the bending of the tubes 6 as viewed in a plan view as compared with the lower ends thereof. In other words, the major axes of the cross sections are inclined so that the upper portions in the vertical direction more approach FFC 9. Therefore, the points 6*c* of the tubes 6, which are disposed nearest to FFC 9 in relation to the paper feeding direction, are disposed upwardly as compared with the centers of the tubes 6. FFC 9 hardly rides on the tubes 6, and the tubes 6 are not damaged by FFC 9.

According to the embodiment explained above, the tubes 6 are disposed in the vertical direction at the fixed portions 6*a*, while the connecting ports 3*c* of the ink-jet head 3 are disposed in the paper feeding direction. Therefore, it is possible to decrease the length of the ink-jet head 3 in relation to the vertical direction as compared with such a case that the connecting ports 3*c* are disposed in the vertical direction in the same manner as the direction of arrangement of the tubes 6 at the fixed portions 6*a*.

The tubes 6 are arranged in the bent state, and hence the reaction forces F1 to F4, which intend to restore the tubes 6 from the bent state to the original state, are generated in the tubes 6. The reaction forces F1 to F4 also act in the vertical direction. The tubes 6 have the substantially elliptical cross-sectional shapes, and the tubes 6 are arranged so that the major axis directions thereof are parallel to the vertical direction at the fixed portions 6*a*. Therefore, the thicknesses of the tubes 6 in the bending direction are decreased. Accordingly, the reaction forces F1 to F4 described above are decreased, and the tubes 6 can be prevented from floating upwardly.

On the other hand, the thicknesses of the tubes 6 are increased in relation to the direction perpendicular to the bending direction. Therefore, the water of the inks contained in the spaces 6*b* can be prevented from escaping to the outside, and the air can be prevented from entering the spaces 6*b* from the outside.

Further, the four tubes 6 are fixed while being mutually bundled by the connecting member 13 at the first ends thereof connected to the connecting ports 3*c*. Therefore, the four tubes 6 can be connected to the connecting ports 3*c* at once. When the tubes 6 are connected in the twisted state such that the major axis directions of the cross sections are the paper feeding direction at the first ends connected to the connecting ports 3*c*, and the major axis directions of the cross sections are the vertical direction at the fixed portions 6*a*. Accordingly, the tubes 6 can be easily connected to the connecting ports 3*c*.

The minor axis directions of the cross sections of the tubes 6 are the vertical direction at the connecting ports 3*c*. Therefore, it is possible to decrease the length of the ink-jet head 3 in relation to the vertical direction.

FFC 9 is arranged on the inner circumferential side of the bending of the tubes 6 as viewed in a plan view so that the FFC 9 is disposed adjacently to the tubes 6. The cross sections, which are provided at the portions of the tubes 6 between the connecting ports 3*c* and the fixed portions 6*a*, are inclined so that the upper ends in the major axis directions are positioned on the inner circumferential side of the bending of the tubes 6 as viewed in a plan view as compared with the lower ends. The points 6*c* of the tubes 6, which are disposed nearest to FFC 9 in relation to the paper feeding direction, are disposed upwardly as compared with the centers of the tubes 6. Therefore, FFC 9 hardly rides on the tubes 6.

Next, an explanation will be made about modified embodiments in which various modifications are applied to the embodiment of the present invention. However, those constructed in the same manner as the embodiment of the present invention are designated by the same reference numerals, any explanation of which will be appropriately omitted.

Figure 6:
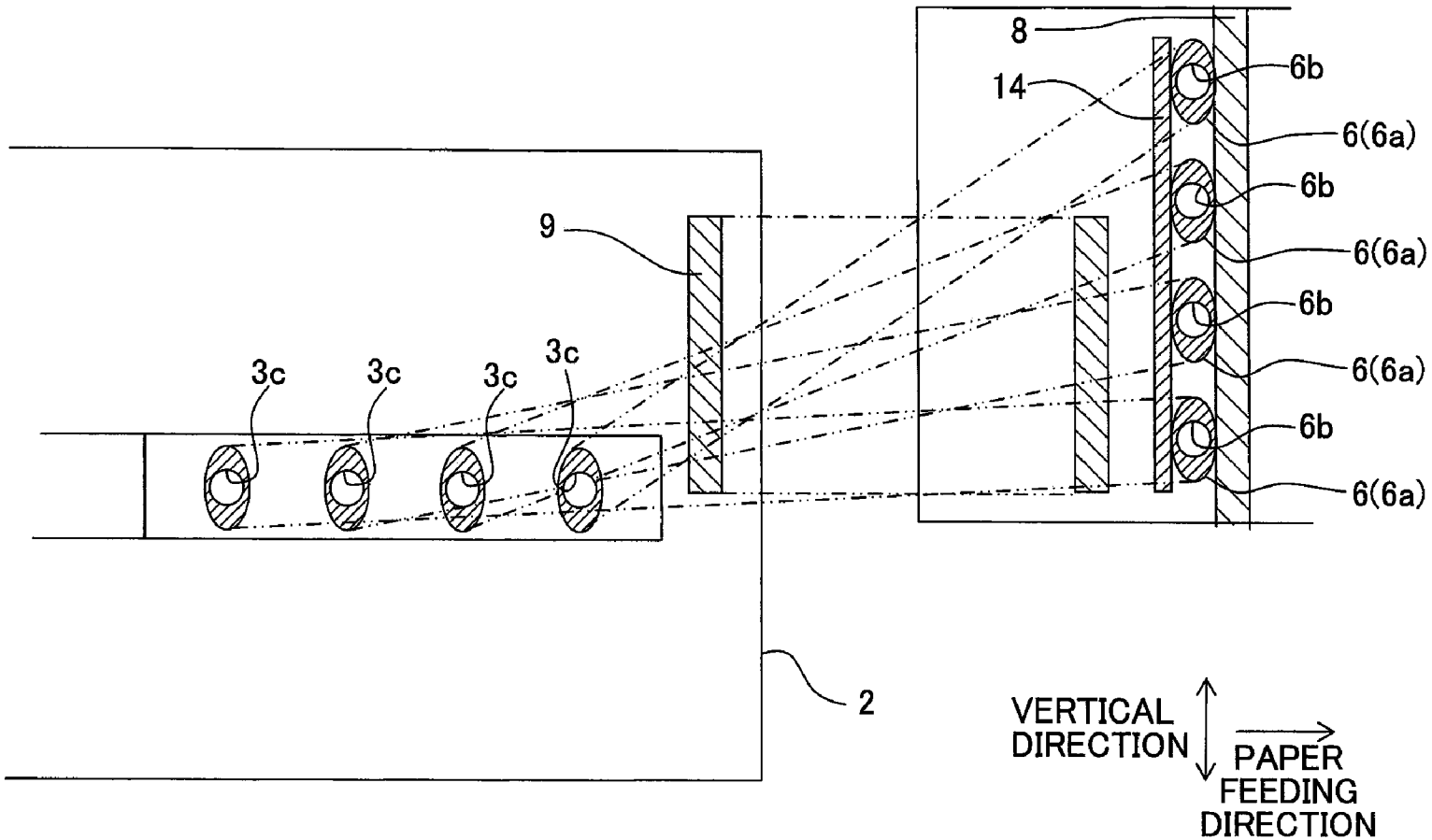
FIG. 6 shows a view of a first modified embodiment corresponding to FIG. 3.
Figure 7:
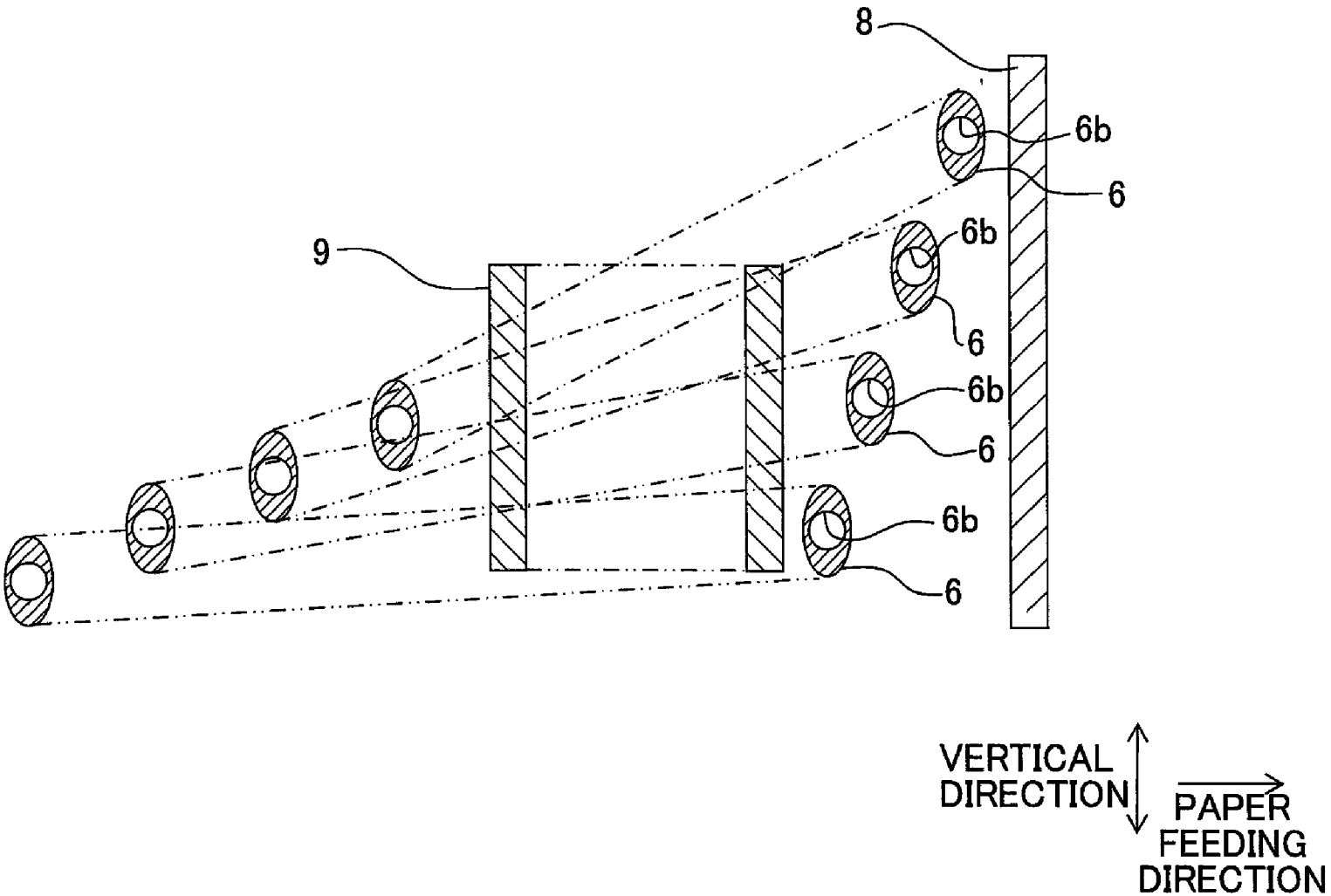
FIG. 7 shows a view of the first modified embodiment corresponding to FIG. 4.

In one modified embodiment, as shown in FIGS. 6 and 7, the tubes 6 are not mutually fixed at the first ends connected to the connecting ports 3*c*, and the major axis directions of the cross sections are the vertical direction at both of the fixed portions 6*a* and the first ends connected to the connecting ports 3*c* (first modified embodiment).

In this case, as shown in FIGS. 6 and 7, the major axis directions of the cross sections are parallel to the vertical direction over the entire regions of the tubes 6. The thicknesses of the tubes 6 are especially decreased in relation to the directions in which the tubes 6 are bent. Therefore, it is possible to especially decrease the magnitudes of the reaction forces generated in the tubes 6.

Also in the embodiment of the present invention, it is allowable that the first ends of the tubes 6, which are connected to the connecting ports 3*c*, are not mutually fixed in the same manner as in the first modified embodiment.

Figure 8:
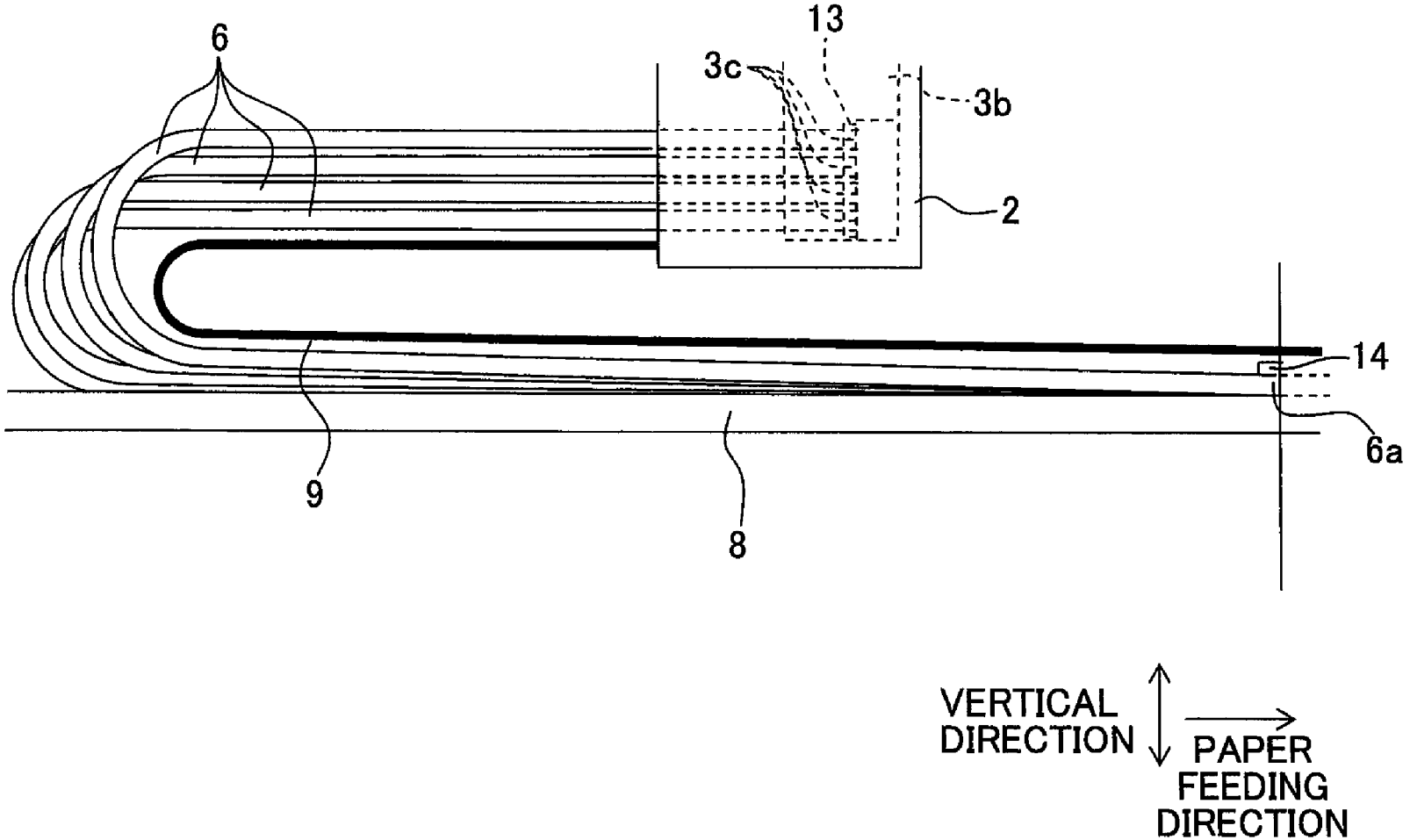
FIG. 8 shows a view of a second modified embodiment corresponding to FIG. 2.
Figure 9:
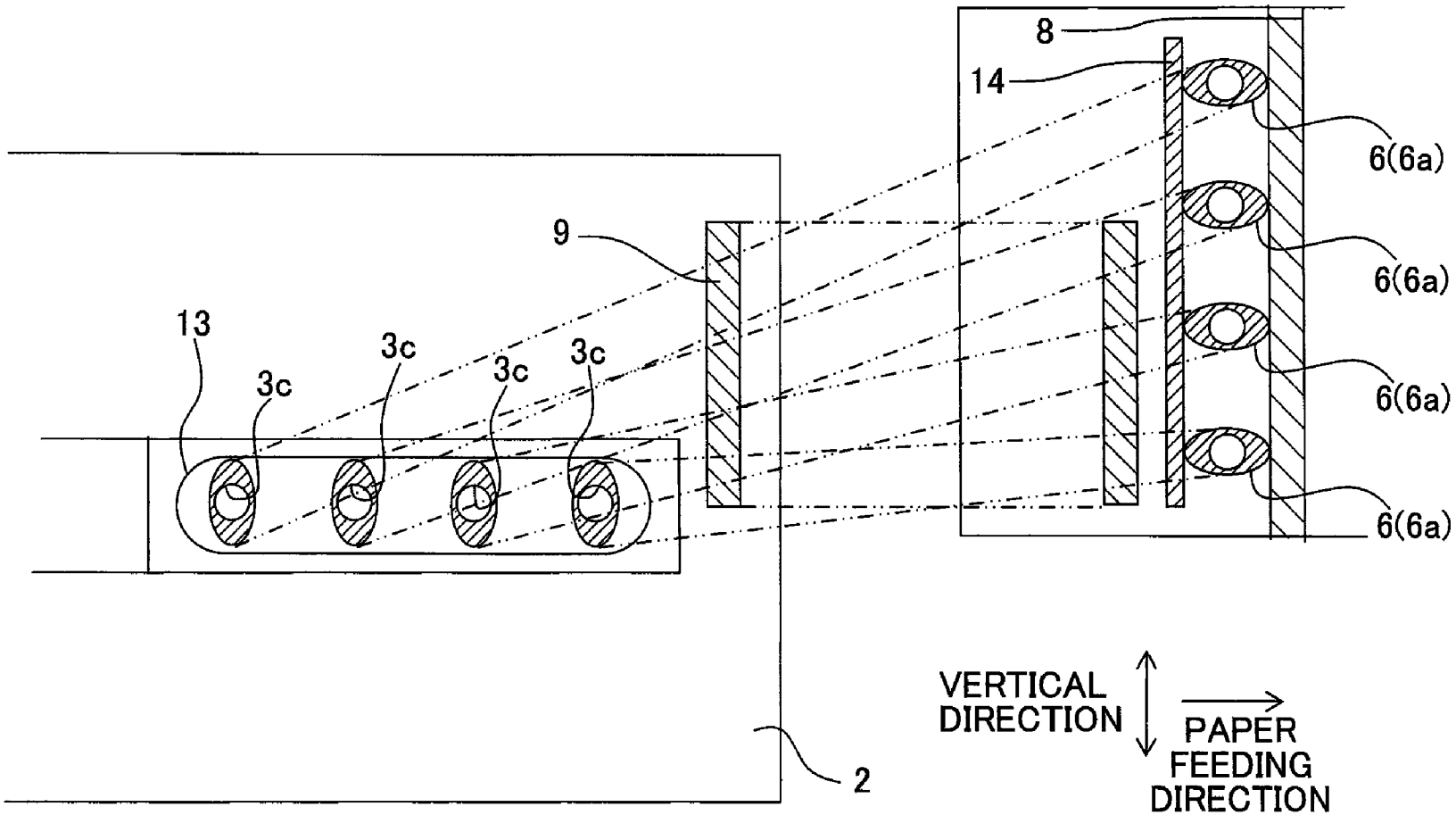
FIG. 9 shows a view of the second modified embodiment corresponding to FIG. 3.
Figure 10:
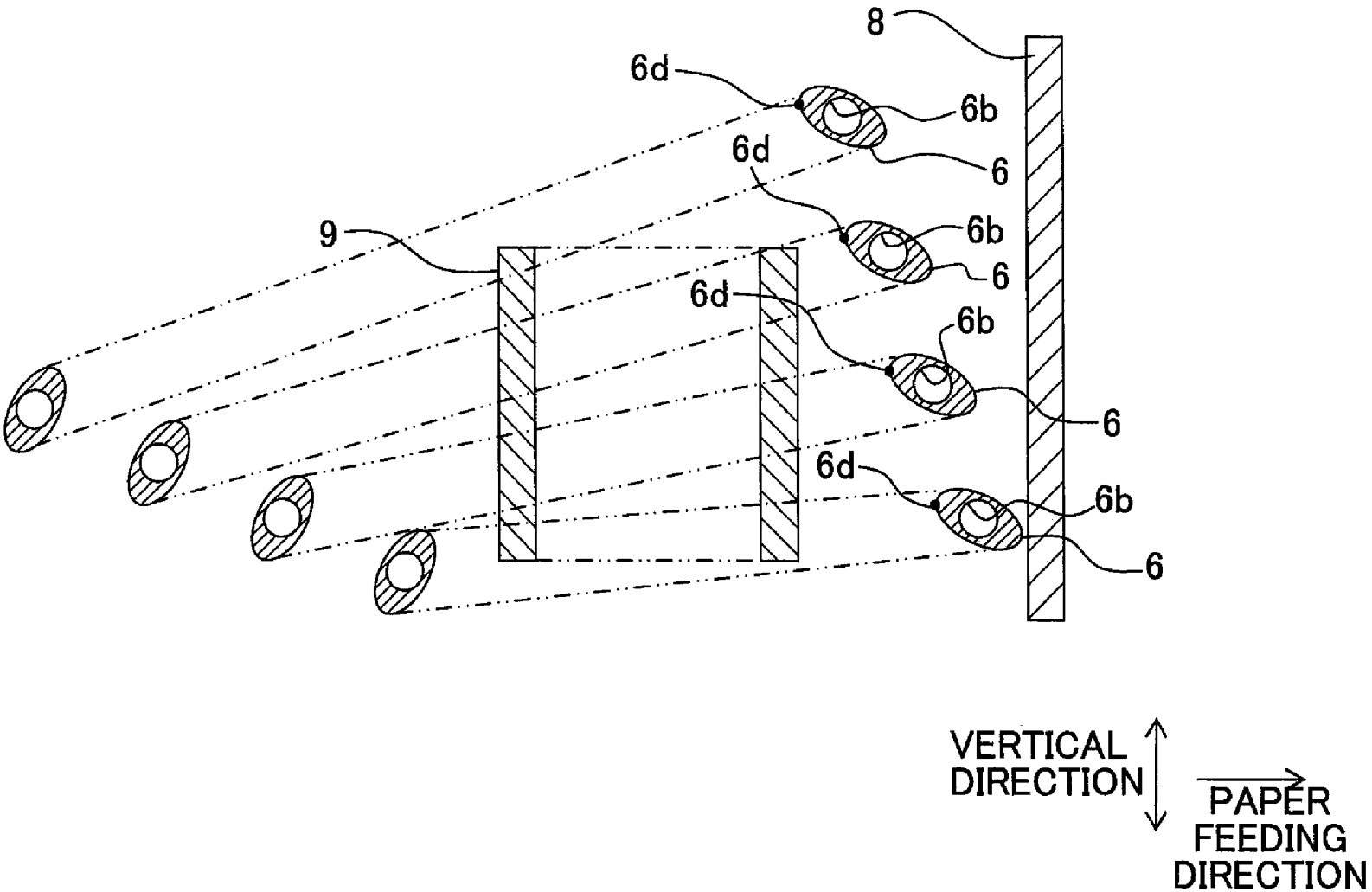
FIG. 10 shows a view of the second modified embodiment corresponding to FIG. 4.

In another modified embodiment, as shown in FIGS. 8 to 10, the major axis directions of the cross sections of the tubes 6 are the paper feeding direction (left-right direction as viewed in FIG. 9) at the fixed portions 6*a*. Further, a twisted state is provided so that the tube 6, which is positioned more upwardly (on the other side in the third direction) at the fixed portion 6*a*, is connected to the connecting port 3*c* of the ink-jet head 3 positioned on the outer circumferential side (upper side shown in FIG. 8) of the bending of the tubes 6 as viewed in a plan view, and the major axis directions of the cross sections are parallel to the vertical direction at the first ends connected to the connecting ports 3*c* (second modified embodiment).

Even in this case, as shown in FIG. 10, the major axes of the cross sections of the tubes 6 are inclined at the portions disposed between the connecting ports 3*c* and the fixed portions 6*a* so that the upper ends thereof are disposed on the inner circumferential side (left side in FIG. 10) of the bending of the tubes 6 as viewed in a plan view as compared with the lower ends thereof. The points 6*d* of the tubes 6, which are nearest to FFC 9 in relation to the paper feeding direction, are disposed upwardly as compared with the centers of the tubes 6. Therefore, FFC 9 hardly rides on the tubes 6.

Further, in this case, as shown in FIGS. 8, 9 and 10, the tube 6, which is positioned more upwardly at the fixed portion 6*a*, is greatly separated from the fixed portion 6*a* in relation to the paper feeding direction. In other words, a first tube 6, among the tubes 6, of which fixed portion 6*a* is positioned at an upper position than that of a second tube 6, among the tubes 6, is connected to a first connecting port 3*c*, among the connecting ports 3*c*, positioned further from the fixed portions 6*a* than a second connecting port 3*c*, among the connecting ports 3*c*, to which the second tube 6 is connected. Therefore, the tube 6, which is positioned more downwardly and which has a high possibility to allow FFC 9 to ride thereon, is located at the position separated farther from FFC 9 in relation to the paper feeding direction. Therefore, FFC 9 more hardly rides on the tubes 6.

Also in this case, the thicknesses of the tubes 6 are decreased in relation to the directions in which the tubes 6 are bent. Therefore, it is possible to prevent the tubes 6 from floating upwardly, and it is possible to prevent the tubes 6 from being entangled with each other, in the same manner as in the embodiment described above. Further, the thicknesses are increased in relation to the directions perpendicular to the directions in which the tubes 6 are bent. Therefore, the water in the inks contained in the spaces 6*b* can be prevented from escaping to the outside, and the air can be prevented from entering the spaces 6*b* from the outside.

In the foregoing description, the connecting ports 3*c* of the ink-jet head 3 are arranged downwardly as compared with all of the fixed portions 6*a*. Alternatively, the connecting ports 3*c* of the ink-jet head 3 are arranged at the same height as that of the fixed portion 6*a* positioned at the lowermost position. However, the connecting ports 3*c* may be arranged upwardly as compared with the fixed portion 6*a* positioned at the lowermost position.

Even when the fixed portions 6*a* and the connecting ports 3*c* are in any positional relationship in relation to the vertical direction, at least three of the fixed portions 6*a* are arranged at the heights different from that of the connecting ports 3*c*, on condition that the tubes 6 are arranged in the vertical direction at the fixed portions 6*a* and the connecting ports 3*c* are arranged in the paper feeding direction. The reaction forces, which are generated in the tubes 6, act in the vertical direction, and it is feared that the tubes 6 may float upwardly. However, even in such a situation, when the tubes 6 are arranged so that the major axis directions of the cross sections of the tubes 6, which are provided in relation to at least one of the fixed portions 6*a* and the first ends connected to the connecting ports 3*c*, are the vertical direction, then the thicknesses of the tubes 6 are decreased in the directions in which the tubes 6 are bent, and the reaction forces, which are generated in the tubes 6, are decreased, in the same manner as in the embodiment described above. The thicknesses of the tubes 6 are increased in relation to the directions perpendicular to the directions in which the tubes 6 are bent. Therefore, the water in the inks contained in the spaces 6*b* can be prevented from escaping to the outside, and the air can be prevented from entering the spaces 6*b* from the outside.

In the embodiment and the modified embodiments of the present invention, the four connecting ports 3*c* of the ink-jet head 3 are arranged in the paper feeding direction perpendicular to the scanning direction (the second direction is the same as the direction which is parallel to the predetermined plane and which is perpendicular to the first direction). However, the four connecting ports 3*c* may be arranged in the scanning direction. Alternatively, the four connecting ports 3*c* may be arranged in any direction other than the scanning direction and the paper feeding direction, the direction being parallel to the horizontal plane.

In the embodiment and the modified embodiments of the present invention, the four tubes 6 are provided. However, the number of the tubes 6 may be two, three, or five or more.

Figure 11A:
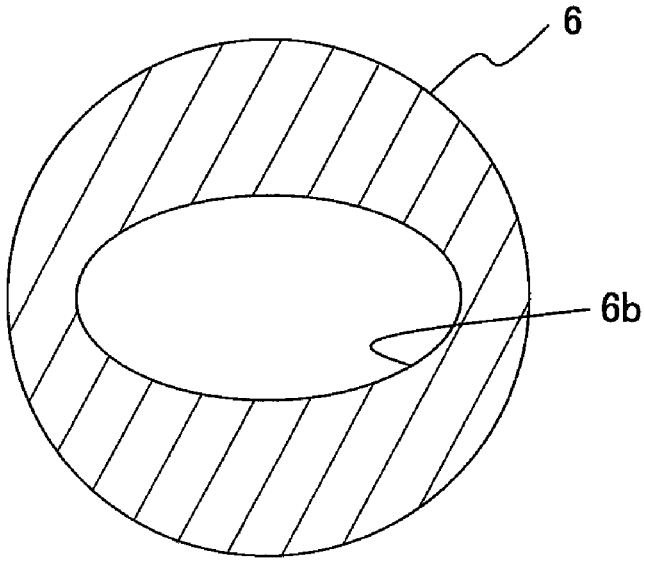
FIGS. 11A and 11B show sectional views of tubes in another modified embodiment.
Figure 11B:
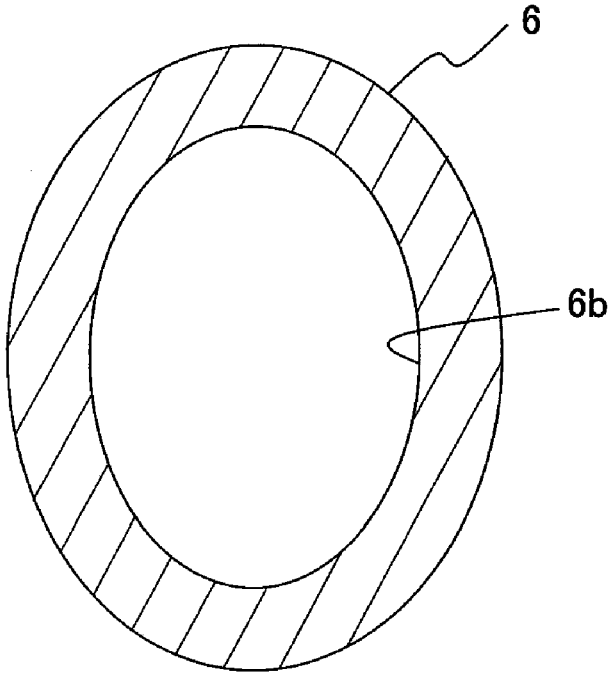

In the embodiment and the modified embodiments of the present invention, the cross section, which is provided in the direction perpendicular to the extending direction of the tube 6, has the elliptical external shape and the circular internal shape. Therefore, the thickness in the major axis direction of the cross section of the tube 6 is thicker than the thickness in the minor axis direction. That is, the thickness, which is in the direction perpendicular to the bending direction of the tube 6, is thicker than the thickness in the bending direction. However, the cross-sectional shape of the tube 6 is not limited thereto. For example, as shown in FIG. 11A, if the tube 6 has a circular external shape and an elliptical internal shape, the thickness of the tube 6 in the major axis direction of the elliptical internal shape is thinner than that in the minor axis direction of the elliptical internal shape. Therefore, the tube 6 can be easily bent in the major axis direction of the elliptical internal shape, and it is possible to prevent the reaction force of the tube 6. On the other hand, the thickness of the tube 6 in the minor axis direction of the elliptical internal shape is thicker than that in the major axis direction of the elliptical internal shape. Therefore, the water in the ink contained in the space 6*b* can be prevented from escaping to the outside, and the air can be prevented from entering the space 6*c* from the outside. As shown in FIG. 11B, the tube 6 may have an elliptical external shape and an elliptical internal shape so that the tube 6 has constant wall thickness. In this case, since the tube 6 has constant wall thickness, the tube 6 can be easily bent in the minor axis direction of the elliptical shape and can not be easily bent in the major axis direction of the elliptical shape. Accordingly, the tube 6 can be arranged such that the tube 6 is bent in the minor axis direction of the elliptical shape.

In the embodiment and the modified embodiments of the present invention, the shape of the cross section of the tube 6, which is provided in the direction perpendicular to the extending direction, is substantially elliptical in the entire area ranging from one end or the first end to the other end or the second end. Further, the space 6*b*, which is formed therein, has the cross section which is circular in relation to the concerning direction. However, it is not necessarily indispensable that the cross-sectional shape as described above should be provided in the entire area of the tube 6. It is enough that at least the portion, which contributes to the bending of the tube, has the foregoing cross-sectional shape. For example, with reference to FIG. 1, it is enough that the portion of the tube 6, which is bent when the carriage 2 is moved to the position nearest to one end side (left side in FIG. 1) in the scanning direction, has the cross-sectional shape which is the foregoing cross-sectional shape.

In the foregoing description, the exemplary embodiments have been explained, in which the present invention is applied to the printer for performing the printing on the recording paper sheet P by discharging the inks from the nozzles 10 which are moved in the scanning direction together with the carriage 2. However, the present invention is also applicable to any liquid discharge apparatus which is movable in the scanning direction and which discharges any liquid other than the ink from nozzles.

What is claimed is:

1. A liquid discharge apparatus which discharges liquids, comprising:

a liquid discharge head which reciprocates in a first direction on a predetermined plane, which discharges the liquids from nozzles and which has a plurality of connecting ports arranged in a second direction on the predetermined plane;

liquid supply sources which store the liquids to be supplied to the liquid discharge head;

a plurality of flexible tubes which are arranged in a state of being bent and each of which constructs a part of a liquid flow passage from one of the liquid supply sources to the liquid discharge head; and a flexible wiring member which applies a driving electric potential to the liquid discharge head;

wherein first ends of the tubes are connected to the connecting ports respectively;

wherein the tubes are fixed to the liquid discharge apparatus at fixed portions of the tubes in a state that the tubes are arranged in a third direction intersecting the predetermined plane, the fixed portions being located at positions different from positions of the connecting ports of the liquid discharge head in relation to a direction which is perpendicular to the first direction and parallel to the predetermined plane; and wherein each of the tubes has a cross section which is perpendicular to an extending direction of the tube and which has an elliptical external shape;

wherein, in at least at one of the first end and the fixed portion, a major axis direction of the elliptical external shape is the third direction; and wherein the flexible wiring member has a width in the third direction and which is smaller than sum of lengths of major axes of the tubes arranged in the third direction at the fixed portions.

2. The liquid discharge apparatus according to claim 1;

wherein each of the fixed portions is formed in one of the tubes at an intermediate portion thereof.

3. The liquid discharge apparatus according to claim 1;

wherein each of the tubes has a cross section which is perpendicular to the extending direction and which has a circular internal shape.

4. The liquid discharge apparatus according to claim 1;

wherein each of the tubes has a constant wall thickness.

5. The liquid discharge apparatus according to claim 1, further comprising:

a guide member which is arranged adjacent to the bent tubes on an outer circumferential side of the bent tubes and which extends in the first direction.

6. The liquid discharge apparatus according to claim 1, further comprising:

a fixing member which fixes the fixed portions of the tubes to the liquid discharge apparatus.

7. The liquid discharge apparatus according to claim 1;

wherein at both of the first end and the fixed portion, the major axis direction of the elliptical external shape of each of the tubes is the third direction.

8. The liquid discharge apparatus according to claim 1, further comprising:

a connecting member which fixes the first ends of the tubes while aligning the first ends in one array, wherein the tubes are connected to the connecting ports via the connecting member; and wherein the tubes are arranged in a twisted state so that the major axis direction of the elliptical external shape of each of the tubes at one of the first end and the fixed portion is the third direction and that the major axis direction of the elliptical external shape at the other of the first end and the fixed portion is the second direction.

9. The liquid discharge apparatus according to claim 8;

wherein the third direction is a vertical direction;

wherein the connecting ports of the liquid discharge head are arranged at positions same as or below one of the tubes positioned on a lowermost side in the vertical direction at the fixed portions;

wherein the flexible wiring member is arranged in a state of being bent along the tubes adjacently to an inner circumferential side of the bent tubes; and wherein the tubes are arranged in a twisted state so that the major axis direction of the elliptical external shape of each of the tubes at the first end is the second direction and the major axis direction of the elliptical external shape of each of the tubes at the fixed portion is the vertical direction, and that a first tube, among the tubes, of which fixed portion is positioned at an upper position in the vertical direction than that of a second tube, among the tubes, is connected to a first connecting port, among the connecting ports, of the liquid discharge head, positioned nearer to the fixed portions than a second connecting port, among the connecting ports, to which the second tube is connected.

10. The liquid discharge apparatus according to claim 8, further comprising:

a flexible wiring member which applies a driving electric potential to the liquid discharge head, wherein the third direction is a vertical direction;

wherein the connecting ports of the liquid discharge head are arranged at positions same as or below one of the tubes positioned on a lowermost side in the vertical direction at the fixed portions;

wherein the flexible wiring member is arranged in a state of being bent along the tubes adjacendy to an inner circumferential side of the bent tubes; and wherein the tubes are arranged in a twisted state so that the major axis direction of the cross section at the first end of each of the tubes is the third direction and the major axis direction of the cross section at the fixed portion of each of the tubes is the second direction, and that a first tube, among the tubes, of which fixed portion is positioned at an upper position in the vertical direction than that of a second tube, among the tubes, is connected to a first connecting port, among the connecting ports, of the liquid discharge head, positioned further from the fixed portions than a second connecting port, among the connecting ports, to which the second tube is connected.

11. The liquid discharge apparatus according to claim 1;

wherein the tubes are arranged in a twisted state so that the major axis direction of the elliptical external shape at the first end of each of the tubes is the third direction, and the major axis direction of the elliptical external shape at the fixed portion of each of the tubes is the second direction.

12. The liquid discharge apparatus according to claim 1;

wherein the tubes have same lengths.

13. The liquid discharge apparatus according to claim 1;

wherein the tubes extend in the first direction from the first ends and each of the tubes is bent back in a U-shape at an intermediate portion thereof.

* * * * *